US006616539B1

(12) United States Patent
Gatto et al.

(10) Patent No.: US 6,616,539 B1
(45) Date of Patent: Sep. 9, 2003

(54) COVERED SANDBOX WITH A DISENGAGING HINGE

(75) Inventors: Jeffrey R. Gatto, Lyndhurst, OH (US); Gregg A. Henderson, Munroe Falls, OH (US)

(73) Assignee: The Little Tikes Company, Hudson, OH (US)

( * ) Notice: Subject to any disclaimer, the term of this patent is extended or adjusted under 35 U.S.C. 154(b) by 0 days.

(21) Appl. No.: 10/144,054

(22) Filed: May 10, 2002

(51) Int. Cl.[7] ..... A63G 31/00
(52) U.S. Cl. ..... 472/126; 220/423; 220/338
(58) Field of Search ..... 472/126; 220/4.22, 220/4.23, 4.24, 337, 338

(56) References Cited

U.S. PATENT DOCUMENTS

| | | | | |
|---|---|---|---|---|
| 2,302,661 A | | 11/1942 | Benson | |
| D257,054 S | | 9/1980 | Ferretti | |
| 4,343,464 A | | 8/1982 | Dose | |
| 4,515,360 A | | 5/1985 | Mariol | |
| 4,561,705 A | * | 12/1985 | Schafer | 312/244 |
| 4,687,100 A | | 8/1987 | Kreeger | |
| 4,854,475 A | | 8/1989 | Riihimaki et al. | |
| D334,789 S | | 4/1993 | Fish, Jr. | |
| 5,211,302 A | * | 5/1993 | Tiramani | 220/4.25 |
| 6,186,357 B1 | * | 2/2001 | Kyle | 220/841 |

* cited by examiner

*Primary Examiner*—Kien T. Nguyen
(74) *Attorney, Agent, or Firm*—Piper Rudnick

(57) ABSTRACT

A sand and water table that includes a sand basin and a water basin. One side of the sand basin includes rotation channels and a locking groove. One side of the water basin includes pivot rods and a locking bead. The pivot rods of the water basin rotate within the rotation channels of the sand basin while the water basin is rotated from a closed position, covering the sand basin, to an open position. As the water basin is rotated to the open position, the locking bead engages the locking groove. The locked bead and groove connection supports the sand basin and the water basin in the open position. When the water basin is rotated to cover the sand basin, the locking bead disengages from the locking groove. The water basin may be removed from the sand basin or may be rotated to cover the sand basin.

22 Claims, 6 Drawing Sheets

COVERED SANDBOX WITH A DISENGAGING HINGE

BACKGROUND OF THE INVENTION

This invention relates generally to a sandbox, and, more particularly to, a sandbox that includes a sand basin and a water basin connected by a hinge that disengages when the water basin is folded on top of the sand basin.

Covered sandboxes are well known in the art. Prior art sandboxes typically include covers that are connected with a hinge. The hinged cover folds over the sandbox to close the sandbox. Sandboxes have also been designed with horizontal channels on the top of the box. The channels receive a cover which slides between a closed position that covers the sandbox and an open position. Sandbox covers have also been used for recreational activities, such as a pool or a playground structure, when not covering the sandbox.

The prior art connections of sandbox covers, however, are not capable of disengaging when the cover is in a closed position. As a result, children or pets may become entrapped in the sandbox.

SUMMARY OF THE INVENTION

Accordingly, it is an object of the present invention to provide a sand basin with a cover connected by a hinge that disengages as the cover is rotated on top of the sand basin.

It is another object of the invention to provide a cover which may be used as a table surface while covering the sand basin and a water basin while in an open position.

It is another object of the invention to provide a recreational sand and water table that prevents entrapment when the water basin covers the sand basin.

It is another object of the invention to provide a sand and water table that is simple and economical to manufacture.

The present invention is directed to a sand and water table that includes a sand basin and a water basin. The sand basin includes four sides and a bottom with a leg positioned at each corner to support the sand basin. One side of the sand basin includes an extension with rotation channels on the top surface of the extension and a locking groove on the bottom surface of the extension. The water basin includes four sides and a bottom with two legs. One side of the water basin includes pivot rods projecting from the top of the water basin and a flange with a locking bead projecting upwards from the bottom of the water basin. The water basin is pivotally connected to the sand basin such that the pivot rods of the water basin rotate within the rotation channels of the sand basin while the water basin is rotated from a closed position that covers the sand basin to an open position.

As the water basin is rotated to the open position, the locking bead engages the locking groove. The locked bead and groove connection support the sand basin and the water basin in the open position. When the water basin is rotated, approximately 20 degrees, towards the sand basin to cover the sand basin, the locking bead disengages from the locking groove. The water basin may be removed from the sand basin or may be rotated to cover the sand basin.

While the water basin is covering the sand basin, the water basin may be removed at any time by lifting the basin up and off of the sand basin. If desired, the water basin may remain covering the sand basin. The two supporting legs of the water basin may be removed providing storage pockets and enabling the bottom of the water basin to provides a table top play surface for children.

The following detailed description of embodiments of the invention, taken in conjunction with the appended claims and accompanying drawings, provide a more complete understanding of the nature and scope of the invention.

DESCRIPTION OF THE PREFERRED EMBODIMENT

Figure 1:
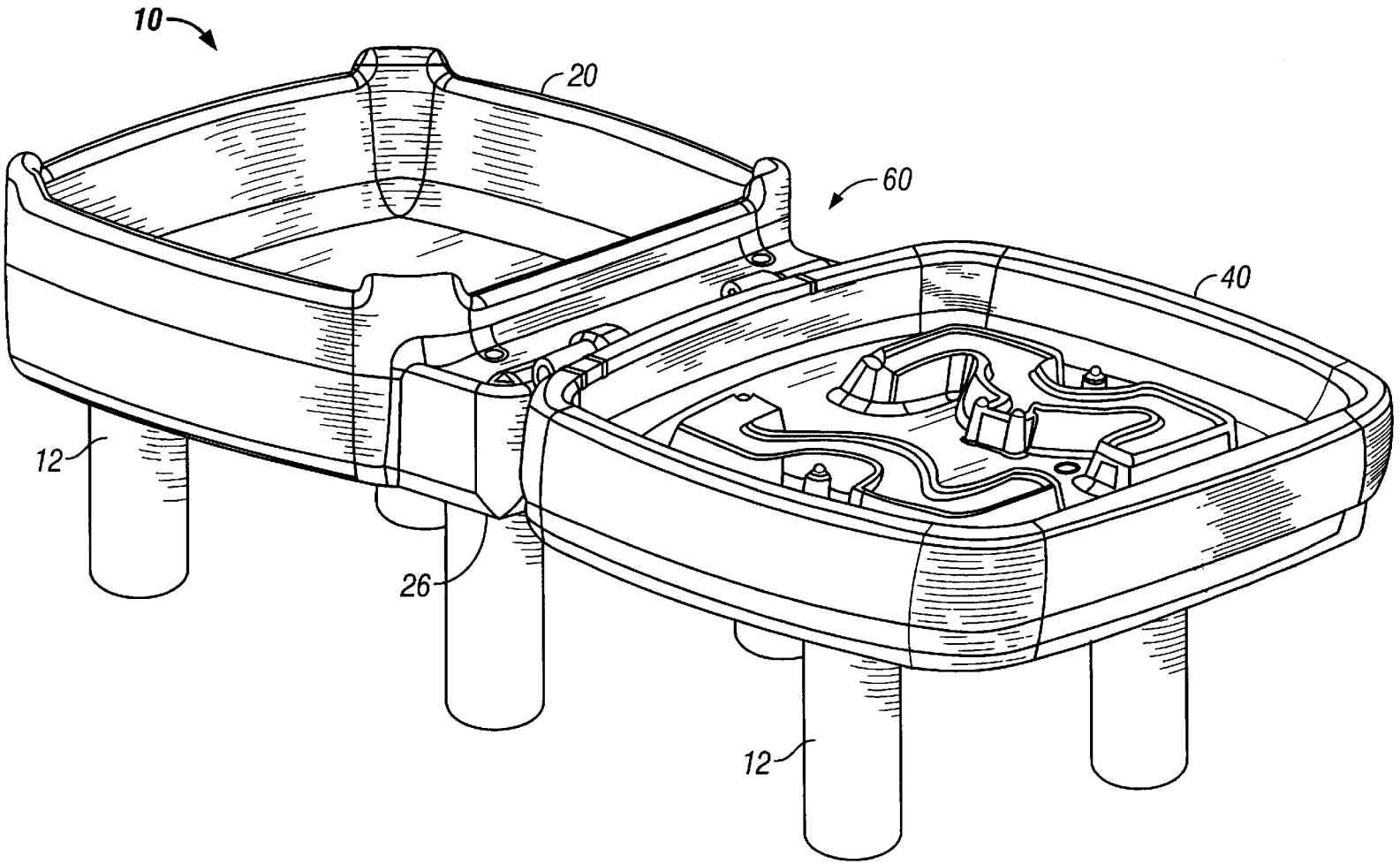
FIG. 1 is a perspective view of the sand and water table of the present invention in a open position.

FIG. 1 illustrates the sand and water table, in general at 10, in an open position. The sand and water table is a toy formed from two molded pieces or halves. The sand and water table includes a sand basin 20 and a water basin 40. The sand basin 20 is supported by a number of legs 12, preferably four, with one leg positioned at each of the outer corners of the sand basin 20 and two legs positioned underneath the extension 26 of the sand basin 20. The water basin 40 is pivotally connected to one side of the sand basin 20 by hinge connection 60. One side of the water basin 40 is supported by a number of legs 12, preferably two, with one leg positioned at each corner while the opposite side is supported by the hinge connection 60 with the sand basin 20. The water basin 40 is designed to provide a water activity center for toy boats. The water activity design includes channels, a draw bridge, spinners that create currents and sailboats. The sand basin and the water basin are formed from rotationally molded plastic.

Figure 2:
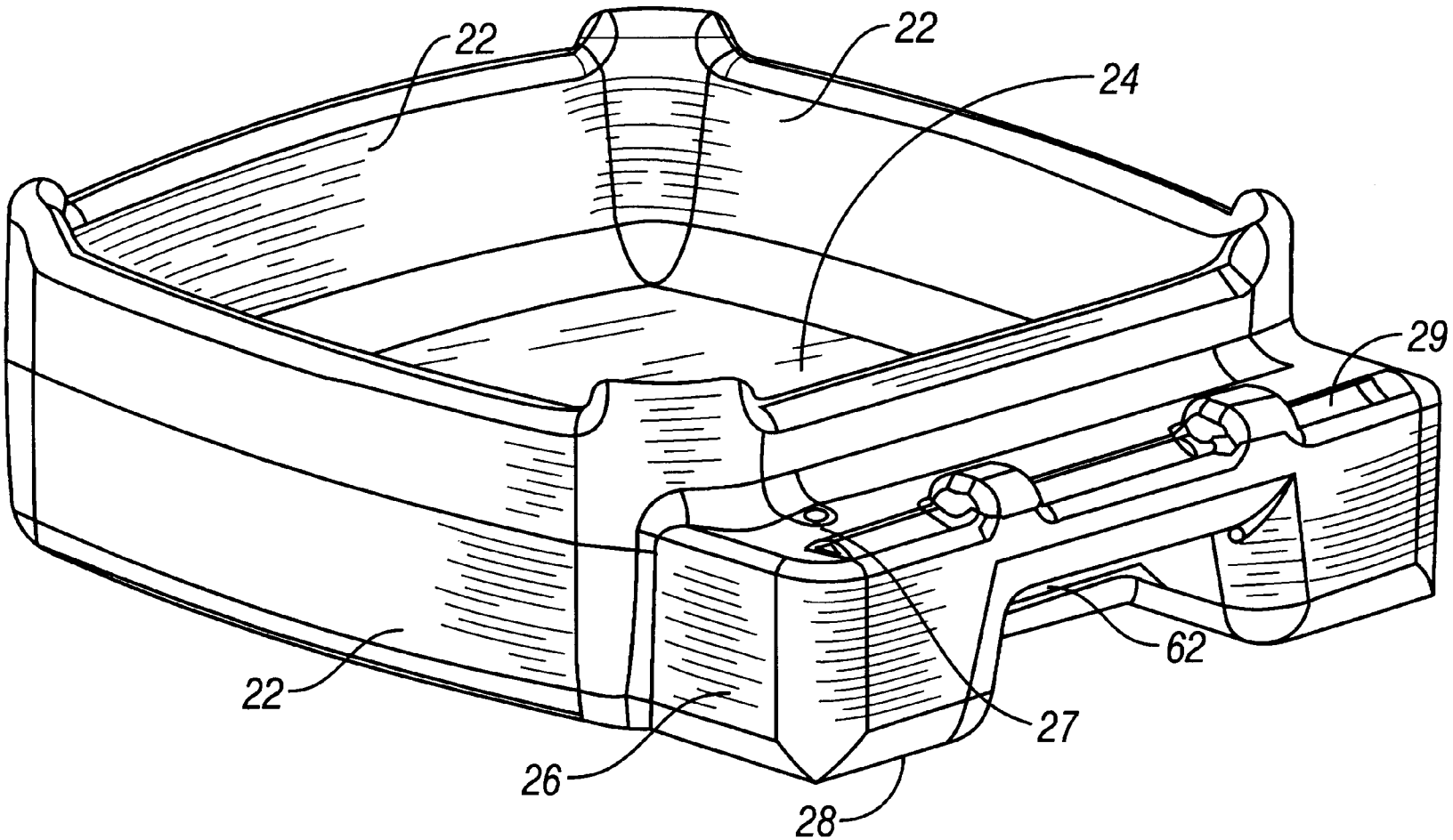
FIG. 2 is a perspective view of the sand basin of FIG. 1.
Figure 4:
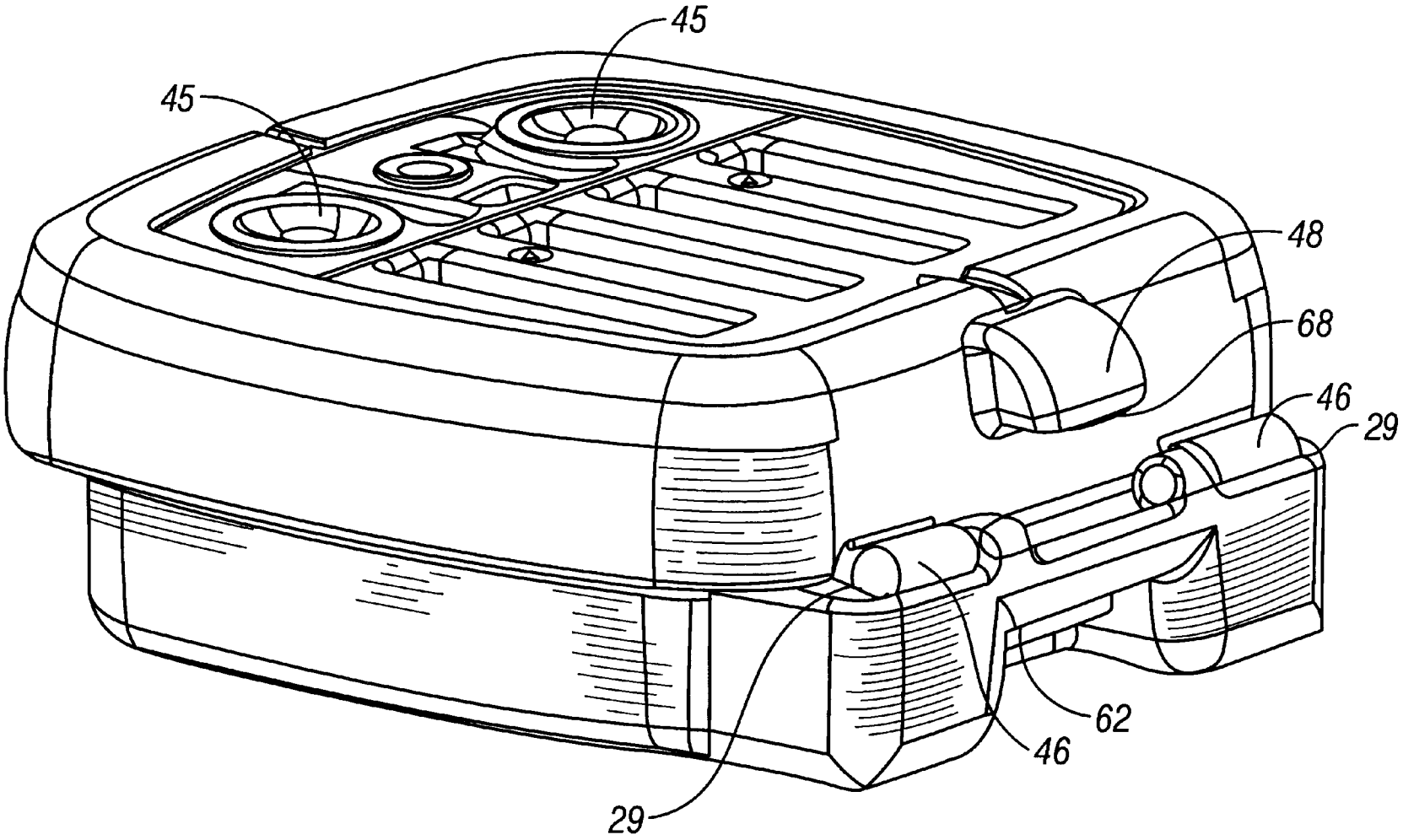
FIG. 4 is a perspective view of the sand and water table of FIG. 1 in a closed position.

The sand basin 20 is illustrated in FIG. 2. The sand basin 20 is preferably formed from one piece and includes a cavity defined by four sides 22 and a bottom 24. The sides 22 extend high enough so that the basin may retain sand or other products that are placed in the basin. An extension 26 extends from one side of the sand basin 20. The extension 26 includes a top surface 27 and a bottom surface 28. The top surface 27 of the extension 26 includes at least one channel, preferably two rotation channels 29. One rotation channel 29 is positioned at each end of the extension 26. The rotation channels 29 are sized to receive the pivot rods 46 of the water basin 40, as illustrated in FIG. 4.

Figure 5:
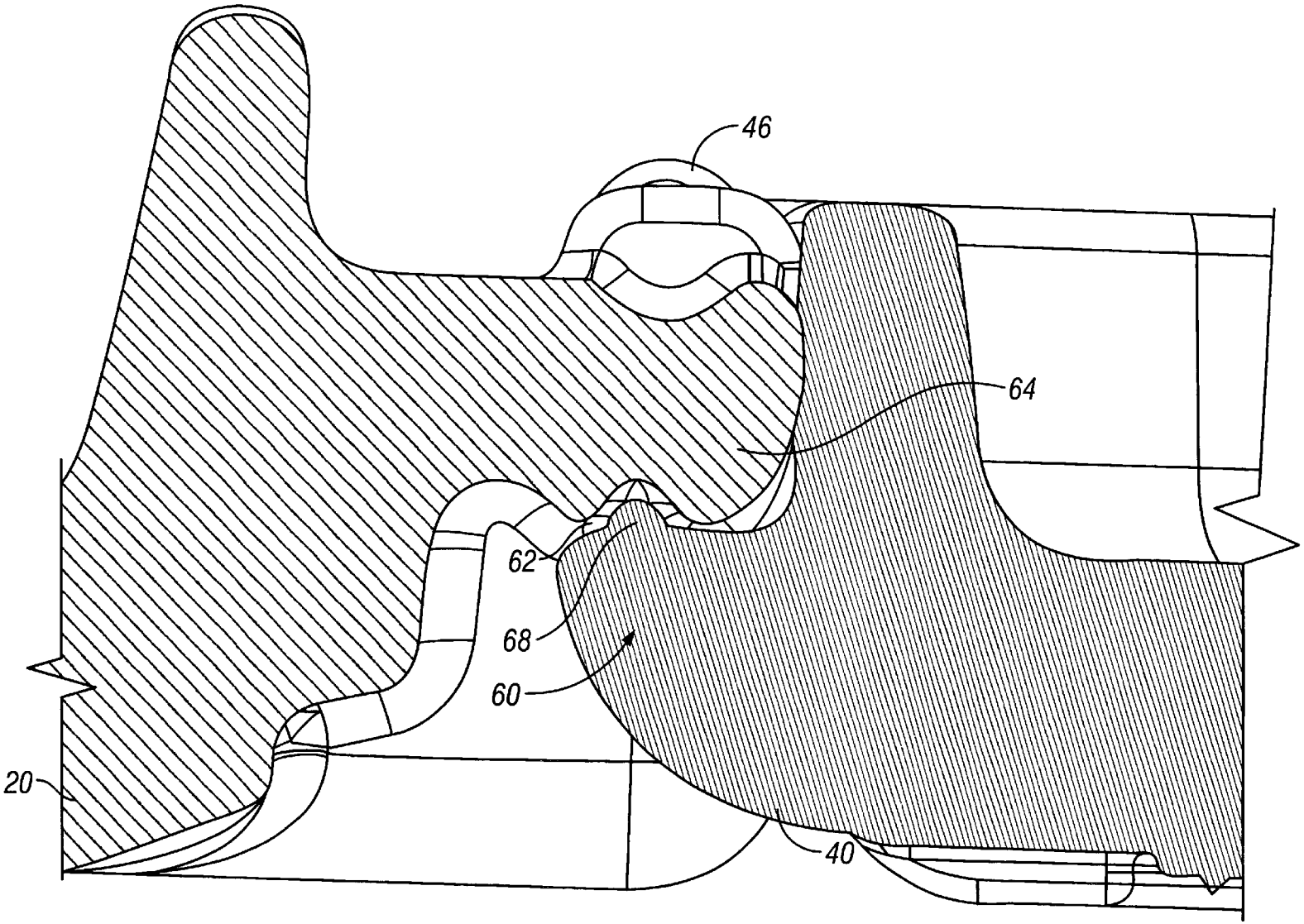
FIG. 5 is a cross-sectional view of the hinge connection of the sand and water table of FIG. 1 in a locked position.

The underside of the extension 26 of the sand basin includes a locking groove 62. The locking groove 62 provides part of the hinge connection 60 that locks and supports the water basin 40 in an open position and releases the water basin 40 from the sand basin 20 when rotated to a closed position. The locking groove 62 is positioned at the center of the underside of the extension 26. As shown in FIG. 5, the locking groove 62 receives the locking bead 68 of the water basin 40. The locking groove 62 maybe formed from a variety of shapes, including but not limited to circular, triangular or elliptical, that mate with the locking bead 68. In the preferred embodiment, the locking groove 62 is semicircular and extends the length of the locking bead 68.

Figure 3:
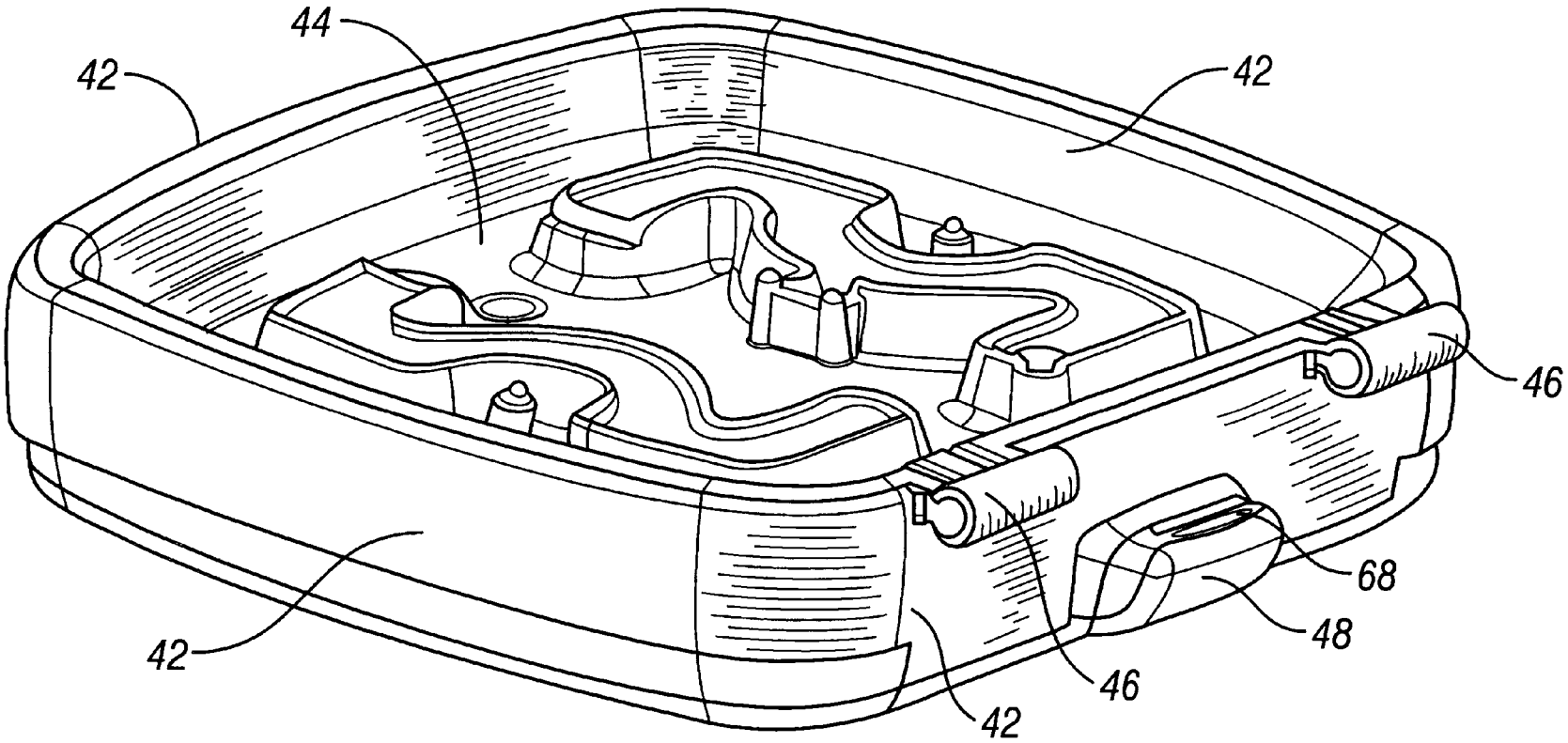
FIG. 3 is a perspective view of the water basin of FIG. 1.

The water basin 40 is illustrated in FIG. 3. The water basin 40 is preferably formed from one piece and includes a cavity defined by four sides 42 and a bottom 44. The sides of the water basin 40 are high enough to retain water. As discussed above, the water basin 40 includes a recreational design that enables children to play with toys, for example a boat in the water. The design includes channels that allow a child to guide their toy boat around the basin. The recreational design also provides an additional safety feature. When the water basin 40 is covering the sand basin 20, as illustrated in FIG. 4, the recreational design occupies the excess space in the sand basin 20. This prevents children or animals from becoming enclosed between the sand basin 20 and the water basin 40 when the water basin 40 is rotated on top of the sand basin 20.

The water basin 40 includes at least one rod, preferably two pivot rods 46 as illustrated in FIG. 3. The pivot rods 46 are positioned at each end of one side of the water basin 40. A flange 48 is also positioned in the middle of the side of the water basin 40. As shown in FIGS. 1 and 4, each pivot rod 46 engages a corresponding rotation channel 29 of the sand basin 20. The pivot rods 46 are cylindrical and sized to rotate in the rotation channels 29 of the sand basin 20. The pivot rods 46 and the channels 29 may be formed from other shapes, including but not limited to, spherical or elliptical.

The flange 48 extends from the bottom of the water basin 40 upwards approximately half the height of the water basin 40. The flange 48 includes a locking bead 68 that extends approximately the length of the flange 48. The locking bead 68 protrudes upwards from the flange 48 and has a semi-circle cross section. The locking bead 68 may be formed from other shapes, such as cylindrical, triangular, elliptical so long as the bead 68 mates with the locking groove 62. The locking bead 68 engages the locking groove 62 to complete the interlock hinge connection 60 of the present invention.

FIG. 4 illustrates the water basin 40 covering the sand basin 20. As illustrated in FIG. 4, the support legs 12 may be removed from pockets 45 thereby providing a storage compartment for beverages or writing utensils, such as markers. Since the bottom surface of the water basin 40 is flat, it may be used as a table top surface when the sand and water table is in a closed position. Thus when the water basin 40 is covering the sand basin 20, the sand and water table provides an additional play or work surface for children.

FIG. 5 illustrates a cross section of the water basin 40 connected to the sand basin 20, in an open position, with the locking bead 68 engaging the locking groove 62. The locking bead 68 applies a force on the locking groove 62 to complete the interlock hinge connection 60. When the water basin 40 is in an open position, the pivot rods 46 apply a force on the rotation channels 29 in a direction opposite of the force applied by the locking bead 68. The opposite applied forces support the connection between the sand basin 20 and the water basin 40. The pivot rods 46 and rotation channels 29 also prevent the hinge connection from sliding in the axial direction.

Figure 6:
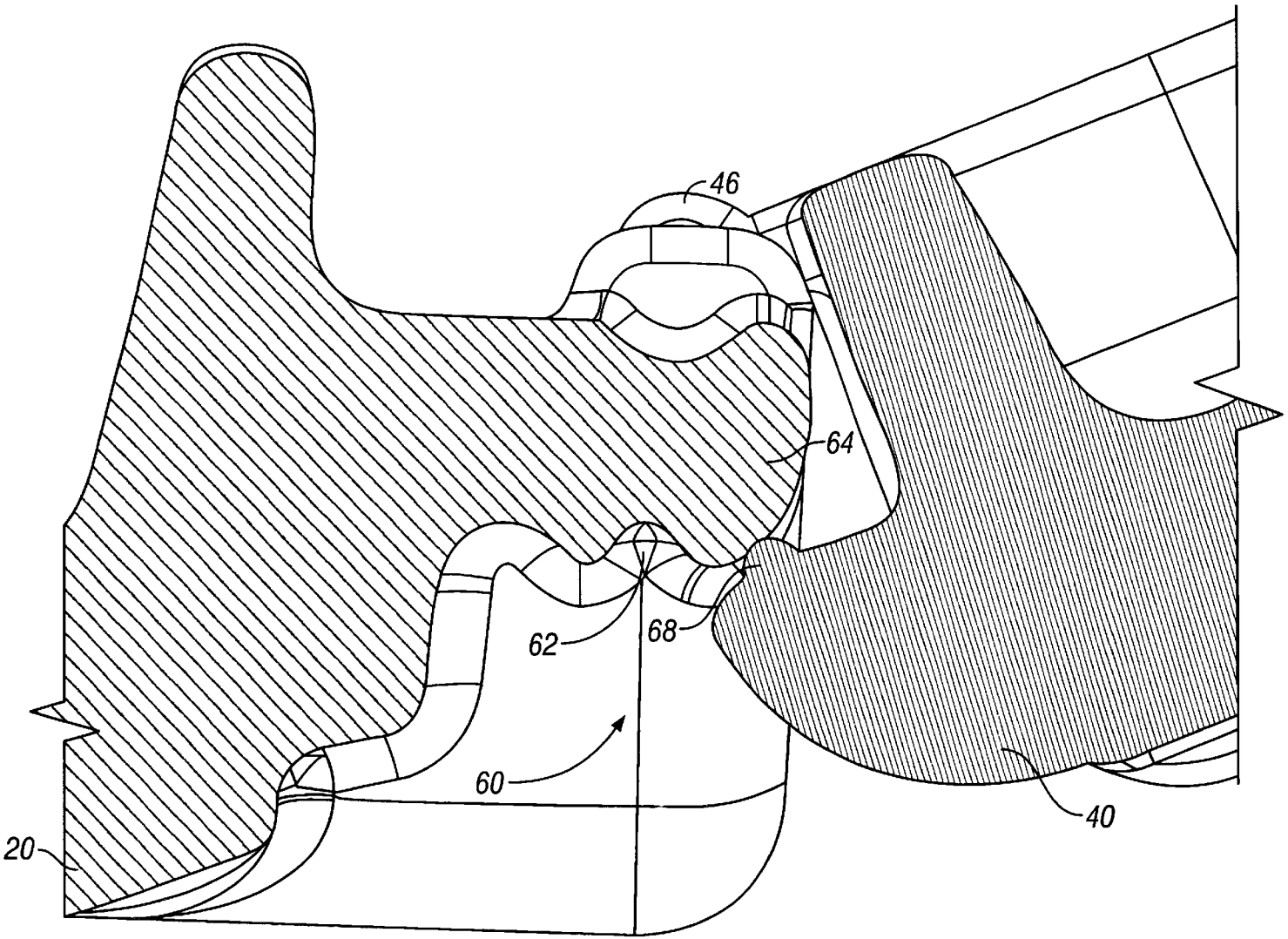
FIG. 6 is a cross-sectional view of the hinge connection of FIG. 5 with the water basin rotated such that the hinge is disengaged.

FIG. 6 illustrates the water basin 40 rotated approximately 20 degrees. As the water basin 40 rotates, the locking bead 68 contacts abutment 64. After the locking bead 68 clears the abutment 64, the locking bead 68 is disengaged from the locking groove 62 and the water basin 40 may be removed from the sand basin 20. The water basin 40 may also be rotated 180 degrees until it is placed on top of the sand basin 20, as illustrated in FIG. 4. If the water basin 40 is rotated to the closed position, the water basin 40 may later be removed by lifting the water basin 40 straight up and off the sand basin 20 since the hinge connection 60 is disengaged. The disengaged hinge connection 60 allows the water basin 40 to safely cover the sand basin 20 since the water basin 40 may be easily removed with a minimal amount of force.

It will be understood that the inventive hinge is not limited to the sand basin 20 and water basin 40. The hinge could be used to couple other shaped molded toy components.

While the preferred embodiment of this invention has been shown and described, it will be apparent to those skilled in the art that changes and modifications may be made therein without departing from the spirit of the invention, the scope of which is defined by the appended claims.

What is claimed is:

1. A two-piece molded folding toy comprising:

a first molded toy half;

a second molded toy half; and a connection means for connecting the second molded toy half to the first molded toy half, wherein the connection means includes a groove positioned on the outer surface of one molded toy half and a bead positioned on the outer surface of the opposite molded toy half, a rod positioned on the outer surface of one molded toy half and a channel positioned on the outer surface of the opposite molded toy half, whereby with the first and second molded toy halves in an open position, the groove lockingly engages the bead such that the bead exerts a force upwardly on the groove and the rod pivots within the channel such that the rod exerts a force downwardly on the channel thereby locking the first and second molded toy halves in an open position.

2. The folding toy of claim 1, wherein the first molded toy half includes an outer surface and the second molded toy half includes an outer surface, the channel is positioned in the outer surface of the first molded toy half and the rod extends from the outer surface of the second molded toy half, whereby the rod rotates in the channel when the second molded toy half rotates from the open position to a closed position.

3. The folding toy of claim 1, wherein the first molded toy half includes an outer surface and the second molded toy half includes an outer surface, the groove is positioned in the outer surface of the first molded toy half and the bead extends from the outer surface of the second molded toy half, whereby the bead disengages from the groove when the second molded toy half rotates toward the first molded toy half.

4. The folding toy of claim 1, wherein the first molded toy half includes a bottom and the second molded toy half includes a bottom, the first molded toy half includes a number of legs positioned on the bottom for supporting the first molded toy half in a raised position, and the second molded toy half includes a number of legs positioned on the bottom for supporting the second molded toy half in a raised position.

5. The folding toy of claim 4, wherein the legs of the second molded toy half are removable when the second molded toy half covers the first molded toy half thereby forming a table top surface.

6. The folding toy of claim 1, wherein the first molded toy half is formed into a single molded piece; and the second molded toy half is formed into a single molded piece.

7. The folding toy of claim 1, wherein an abutment is positioned adjacent the groove for maintaining the bead in a locked position, whereby the bead overcomes the abutment when rotated from inside the groove to a disengaged position.

8. The folding toy of claim 1, wherein the bead disengages from the groove when the second molded toy half rotates toward the first molded toy half.

9. The folding toy of claim 1, wherein the second molded toy half covers the first molded toy half to form a closed toy; whereby the second molded toy half may be lifted up and off of the first molded toy half.

10. A two-piece molded folding toy comprising:

a first basin with an outer surface, an inner surface and two recesses spaced apart and facing away from each other; and a second basin with an outer surface, an inner surface and two projections spaced apart from each other, the second basin is connected to the first basin;

wherein one recess cradles one projection when the folding toy is either opened or closed and the second projection engages the second recess in a locking arrangement when the folding toy is opened.

11. The folding toy of claim 10, wherein the first basin includes an extension; and the spaced apart recesses are positioned in the extension.

12. The folding toy of claim 10, wherein the first basin includes a top and a bottom; and the spaced apart recesses include a channel positioned in the top of the first basin and a groove positioned in the bottom of the first basin.

13. The folding toy of claim 12, wherein the second basin includes a top and a bottom; and the spaced apart projections include a rod extending from the top of the second basin and a bead extending from the bottom of the second basin.

14. The folding toy of claim 13, wherein the groove lockingly engages the bead such that the bead exerts a force upwardly on the groove and the rod pivots within the channel such that the rod exerts a force downwardly on the channel thereby locking the first and second basin in an open position.

15. The folding toy of claim 13, wherein the bead disengages from the groove when the second basin rotates towards the first basin.

16. The folding toy of claim 10, wherein the first basin includes a number of legs for supporting the first basin in a raised position; and the second basin includes a number of legs for supporting the second basin in a raised position.

17. The folding toy of claim 16, wherein the legs of the second basin are removable when the second basin covers the first basin thereby forming a table top surface.

18. The folding toy of claim 10, wherein the first basin is formed into a single molded piece; and the second basin is formed into a single molded piece.

19. The folding toy of claim 10, wherein an abutment is positioned adjacent one of the recesses for maintaining one of the projections in a locked position, whereby the projection overcomes the abutment when rotated from the recess to a disengaged position.

20. The folding toy of claim 10, wherein the second basin covers the first basin to form a closed toy, whereby the second basin may be lifted up and off of the first basin.

21. A two-piece molded folding toy comprising:

a first basin having an outer surface and a cavity with an inner surface;

a second basin connected to said first basin, said second basin having an outer surface and a cavity with an inner surface wherein said second basin is hingedly connected to said first basin; and a raised structure positioned within the cavity of the second basin, the second basin folds over the first basin so that the inner surface of the second basin faces the inner surface of the first basin, and wherein the raised structure within the cavity of the second basin is positioned in the cavity of the first basin, whereby the raised structure prevents entrapment by occupying space in the cavity of the first basin when the cavity of the second basin covers the cavity of the first basin, such that the first basin and second basin are unable to close upon and entrap a child positioned in either cavity.

22. The folding toy of claim 21, wherein the raised structure is a recreational activity center having a waterway path and movable bridges.

* * * * *